US007055177B2

(12) United States Patent
Svrcek

(10) Patent No.: US 7,055,177 B2
(45) Date of Patent: Jun. 6, 2006

(54) FINGER GUARD FOR HAIRSTYLISTS

(76) Inventor: Lori Svrcek, 35 Steeplebush Rd., Essex Junction, VT (US) 05452

( * ) Notice: Subject to any disclaimer, the term of this patent is extended or adjusted under 35 U.S.C. 154(b) by 525 days.

(21) Appl. No.: 10/289,370

(22) Filed: Nov. 7, 2002

(65) Prior Publication Data

US 2004/0088771 A1 May 13, 2004

(51) Int. Cl.
*A41D 13/08* (2006.01)

(52) U.S. Cl. ..... 2/21; 2/163; 30/233

(58) Field of Classification Search ..... 2/169, 2/21, 16, 159, 163, 174, 20, 161.1–161.6, 2/160; 30/233; 132/213–214
See application file for complete search history.

(56) References Cited

U.S. PATENT DOCUMENTS 450,715 A * 4/1891 Lee ..... 2/169
1,584,304 A * 5/1926 Kennedy ..... 2/16
3,928,871 A 12/1975 Wall
4,186,442 A * 2/1980 Kilgore ..... 2/20
4,689,828 A * 9/1987 Brewer ..... 2/21
4,967,419 A * 11/1990 Elliott ..... 2/16
5,363,508 A * 11/1994 Kim ..... 2/21
D358,687 S 5/1995 Kim
5,423,090 A * 6/1995 Gimbel ..... 2/161.7
5,520,626 A * 5/1996 Schaeffer ..... 602/22
5,689,828 A * 11/1997 Mah ..... 2/16
5,781,928 A * 7/1998 Avila ..... 2/16
5,991,918 A * 11/1999 Choate ..... 2/21
6,381,753 B1 * 5/2002 Smith et al. ..... 2/167

* cited by examiner

*Primary Examiner*—John J. Calvert
*Assistant Examiner*—Andrew W. Sutton
(74) *Attorney, Agent, or Firm*—Richard C. Litman

(57) ABSTRACT

A one-piece hand and knuckle guard comprising an index finger sleeve, a middle finger sleeve, a web, and a knuckle shield.

2 Claims, 5 Drawing Sheets

FINGER GUARD FOR HAIRSTYLISTS

BACKGROUND OF THE INVENTION

1. Field of the Invention

The present invention relates generally to protective devices for hands, and more specifically to hand and knuckle guards for hairstylists.

2. Description of the Related Art

Protective devices for the hands and fingers of hairstylists and barbers are well known. Many varieties and styles are on the market today. Some of these devices are merely modified gloves, which are bulky and awkward to use. Other devices consist of protection for one or two fingers and have a wrist strap to hold it in place. Another variety of these protective devices covers only the area of the hands subject to the greatest hazard, but have multiple parts or moving parts, limiting their practicality. The bulkiness and complexity of the existing devices render them impractical for a hairstylist to use.

U.S. Design Pat. No. 358,687, issued to Ok C. Kim on May 23, 1995, discloses a finger and palm guard. However, it includes multiple parts and offers very limited protection from scissors cuts on the back of the knuckles and the fingers.

U.S. Pat. No. 3,928,871, issued to Albert Wall on Dec. 30, 1975, discloses a barber's glove and method. However, the device completely covers two fingers and includes a wrist strap, limiting movement and rendering it impractical for wear when performing other hairstylist tasks, such as washing hair or applying hair color or chemicals while wearing gloves.

U.S. Pat. No. 4,689,828, issued to Janet C. Brewer on Sep. 1, 1987, discloses a protective device for hair stylist's fingers. However, the device requires the use of a wrist strap, rendering it impractical for use or wear in many aspects of the hairstylist's activities.

U.S. Pat. No. 5,363508, issued to Ok C. Kim on November 1994, discloses a finger and palm guard. However, the guard offers limited protection of areas likely to be cut by scissors, and includes multiple parts.

None of the above inventions and patents, taken either singularly or in combination, is seen to describe the instant invention as claimed. Thus a hand and knuckle guard for hairstylists solving the aforementioned problems is desired.

SUMMARY OF THE INVENTION

Hairstylists place great demands on their hands. They perform a multitude of tasks for clients with their hands. These tasks include shampooing, coloring, chemical treatments, and cutting. Cutting is the most hazardous activity of all. A hairstylist's scissors need to be sharp to prevent tearing or pulling on the client's hair and to reduce fatigue in the stylist's hands. However, the stylist will inevitably exhibit some fatigue over the course of a day. Such fatigue is likely to result in errant hand movements, often while using scissors. If the scissors cut the hairstylist's hand, the list of potential problems is lengthy. Blood from the stylist may contaminate the client's hair or scalp. This undesirable situation affords an easy manner to spread communicable diseases, especially if the client has an open wound on his or her head.

An open wound on a stylist's hand is slow to heal. A hairstylist is constantly shampooing, applying chemicals, or cutting. During shampooing, the stylist could wear gloves to protect the hands and the open wound. However, the rubber or plastic gloves may exhibit a high coefficient of friction against the client's hair or scalp. Thus, client discomfort may force the stylist to forego the use of protective gloves. In addition, even where gloves are acceptable, as with the application of hair coloring or other chemicals, the stylist's rubber or plastic gloves trap all sweat and moisture inside the glove. The excess moisture inhibits the healing process.

Stylists receive cuts to their fingers in the same places repeatedly. The damage occurs to the hand that is used to manipulate the client's hair. Typically, such cuts are around the knuckles and web between the index and middle fingers, and the area around the knuckles and first joints of the index and middle fingers. Both the palm side and the back of the stylist's hand may be cut in those aforementioned areas, depending on the cutting technique used.

Other guards are available on the market today. These guards have numerous shortcomings, including bulkiness, inadequate protection, uncomfortableness, or the inability to wear them under a glove.

In the past, the bulkiness of the available finger and hand protectors required a hairstylist to remove the protective devices to wear rubber or plastic gloves for working with hair coloring or other chemicals. Not only was the frequent donning and doffing time-consuming, it also wore out or lead to the premature failure of the protective devices. After removal, the hairstylist often forgot to replace, or consciously disregarded replacing, the hand protection device. A subsequent scissors cut to the hand became particularly maddening. The need for something better was obvious.

Accordingly, it is a principal object of the invention to disclose a hand and knuckle guard that protects the webbing between the index and middle fingers of a hairstylist's hand.

It is another object of the invention to teach a hand and knuckle guard that protects the knuckles for the index and middle fingers on the back of a hairstylist's hand.

It is a further object of the invention to disclose a hand and knuckle guard that protects the knuckles for the index and middle fingers on the palm side of a hairstylist's hand.

Still another object of the invention is to teach a hand and knuckle guard that protects the first joint of the index or middle fingers on the back of a hairstylist's hand.

Yet another object of the invention is to disclose a hand and knuckle guard that protects the first joint of the index or middle fingers on the palm side of a hairstylist's hand.

Still another object of the invention is to disclose a hand and knuckle guard that will not interfere with the use of gloves.

Yet another object of the invention is to teach a hand and knuckle guard that will not interfere with a hairstylist's activities.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a hand guard, more specifically a hand, finger and knuckle guard for hairstylists.

Figure 1:
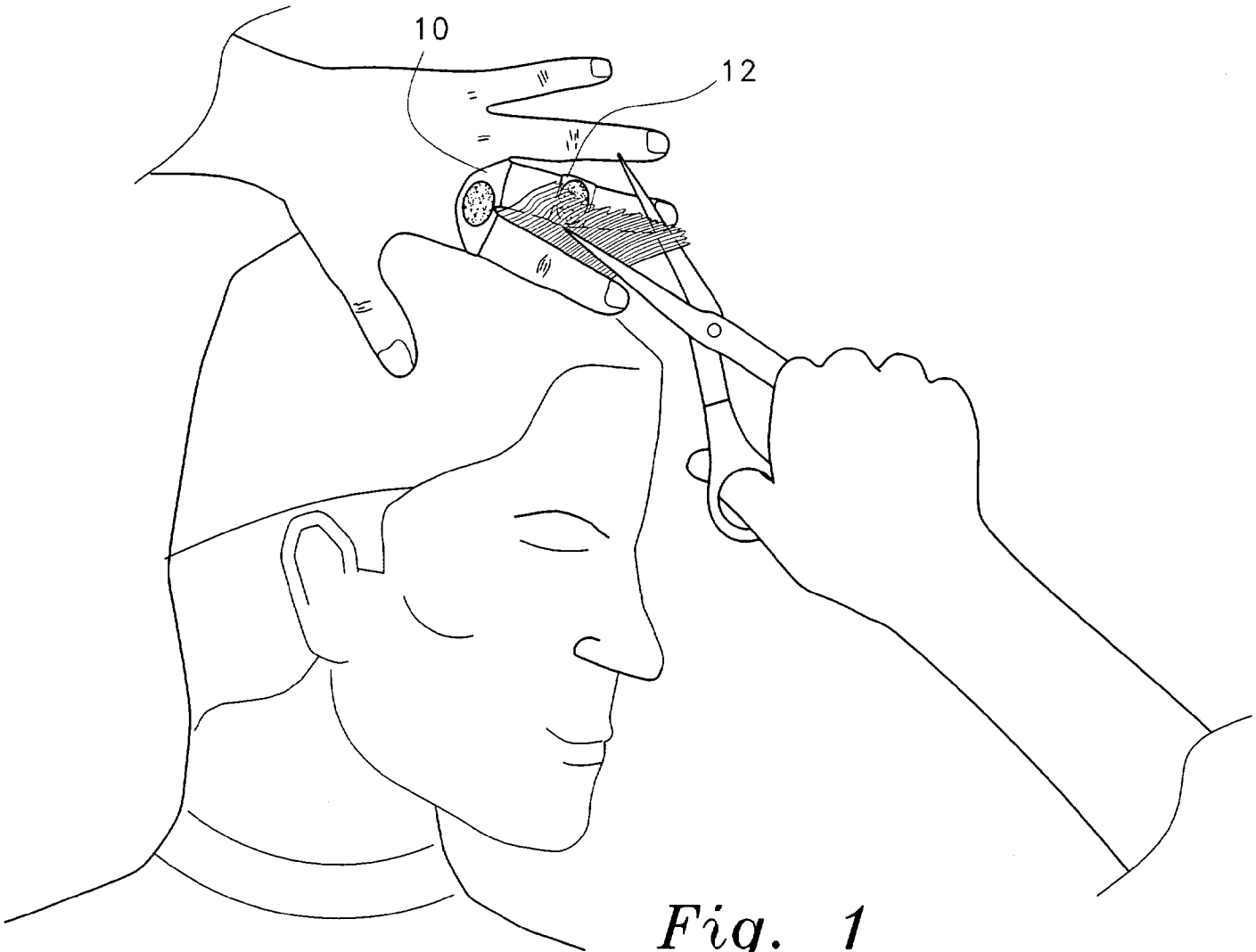
FIG. 1 is an environmental, perspective view of a hand and knuckle guard for hairstylists according to the present invention.

FIG. 1 is an environmental, perspective view of a hand and knuckle guard for hairstylists according to the present invention. The hand and knuckle guard includes a knuckle guard 10 and a finger guard 12. The hand and knuckle guard protects the covered areas from the hazards of sharp scissors.

Figure 2:
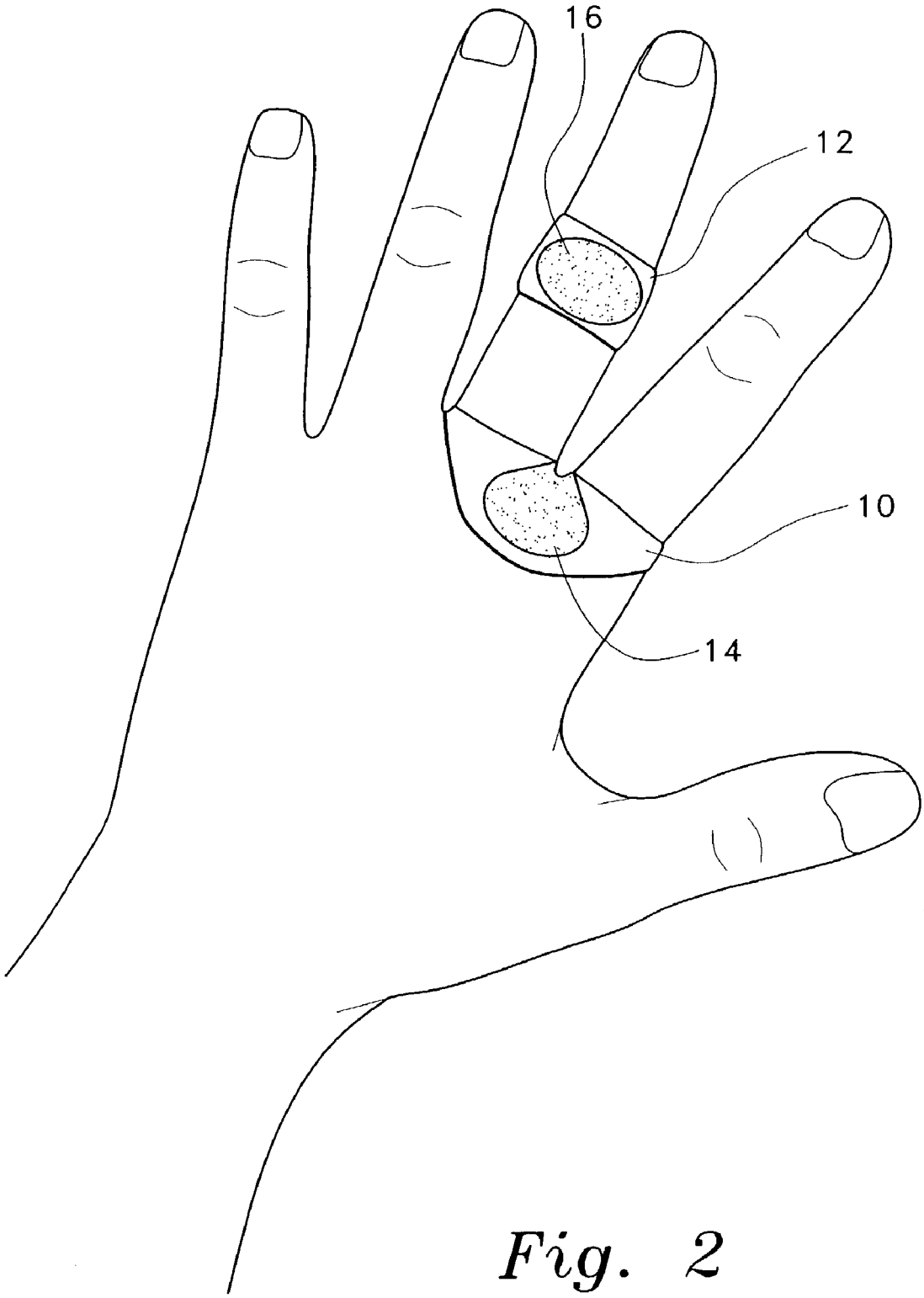
FIG. 2 is a perspective view of the top of a hand wearing a hand and knuckle guard.
Figure 3:
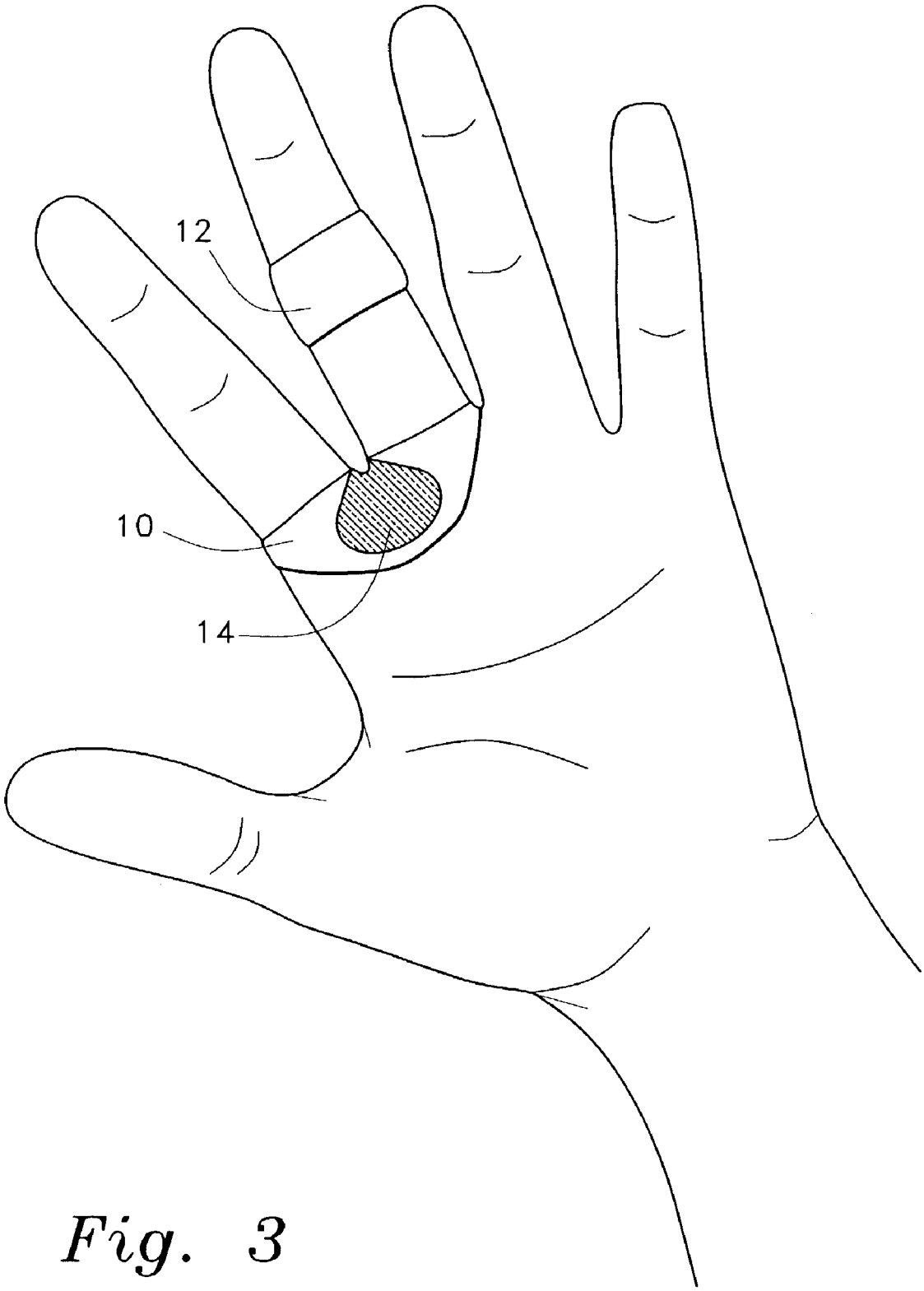
FIG. 3 is a perspective view of the palm of a hand wearing a hand and knuckle guard.

FIGS. 2 and 3 are perspective views of the top and palm of a hand wearing a hand and knuckle guard. The knuckle guard 10 is worn around the base of the index and middle fingers of the hand opposite of that used to operate the scissors. It is slipped over and down the index and middle fingers, like a two-fingered glove, until it is snugly against the base and knuckles of the index and middle fingers.

The finger guard 12 is worn around the first joint of a finger, typically the index or middle finger. The finger guard 12 is slipped over a finger until the finger guard 12 is snugly in place over the first joint of the finger. The user may wear multiple finger guards 12 simultaneously to protect multiple fingers.

Both the knuckle guard 10 and the finger guard 12 are made of a tough, flexible material which allows it to conform to the shape of the wearer's hand in that area, and to resist slipping out of place. Both the knuckle guard 10 and the finger guard 12 are a one-piece design. Thus, the user will select the size appropriate for his or her fingers. When properly fitted, neither the knuckle guard 10 nor the finger guard 12 will slip out of place. Further, they will not restrict blood flow to the fingers, and they will not impair the freedom of movement of the stylist's hands. The slim profile of the knuckle guard 10 and the finger guard 12 permits them to be worn under rubber or plastic gloves. In addition, both the knuckle guard 10 and the finger guard 12 may be created from a combination of a variety of materials to take advantage of beneficial properties.

The knuckle guard 10 is a protective cover that includes a pair of apertures defined therein. The pair of apertures allow for accessibility of the user's index and middle fingers. The knuckle guard 10 is designed to be placed over the index and middle fingers of a user's hand. The knuckle guard 10 is dimensioned and configured to cover the front and back of the first knuckles of the index and middle fingers without covering the phalanges of the index and middle fingers. A phalanx is bone of a finger or a toe. The first side 20 of the knuckle guard 10 covers the index finger. The second side 22 of the knuckle guard 10 covers the middle finger. The knuckle guard 10 is truncated at approximately the top edge of the first knuckles of the index and middle fingers and the bottom edge of the first knuckles of the index and middle fingers. The knuckle guard 10 has an isthmus 24 extending between the two apertures, the isthmus 24 being adapted to cover webbing of a user's hand between the index finger and the middle finger. The knuckle guard 10 has a ventral portion that is configured to cover the palm side of the knuckles and a dorsal portion that is configured to cover the back side of the knuckles. The isthmus 24 extends between the ventral and dorsal portions of the knuckle guard 10. The knuckle guard 10 includes an inset 14 integrated into the knuckle guard 10. The shape of the inset 14 resembles an exaggerated hourglass, with a more bulbous and rounded ends. The narrow middle of the hourglass lays between the user's index and middle finger, across the webbing. This middle of the hourglass is integrated into the isthmus 24 of the knuckle guard 10. One rounded end of the hourglass covers the palm side of the knuckles, while the other rounded end of the hourglass covers the top or back side of the knuckles. This coverage area is the part of a wearer's hand that is most likely to benefit from additional protection.

The finger guard 12 is a band of flexible and cut-resistant material designed to fit around the middle knuckle of a finger. The finger guard 12 has an aperture defined therein that allows for accessibility to the user's finger. The finger guard 12 is designed to be placed over one of the fingers of a user's hand. The finger guard 12 is dimensioned and configured to cover the front and back of the middle knuckle of one of the fingers without covering the phalanges of the finger. The finger guard 10 is truncated at approximately the top edge and the bottom edge of the middle knuckle of one of the fingers. Typically, the hairstylist requires protection for the index finger and the middle finger. The finger guard is designed to offer a snug, nonslip fit that does not impair the flow of blood through the finger, and does not appreciably restrict the wearer's freedom of movement.

The finger guard 12 includes a pad 16 that is integral with the construction of the finger guard 12. The finger guard 12 is slipped over the end of a finger and over the first joint of that finger. The finger guard 12 oriented so that the pad 16 is placed over the back or top of the first joint of that finger. The pad 16 is an area of the finger guard 12 that is made of a different material, or that is simply a different thickness than the rest of the finger guard 12. In the preferred embodiment, the pad 16 is more cut-resistant than the remainder of the finger guard 12. The additional cut-resistance of the pad 16 is accomplished by increasing the thickness of the material used in the remainder of the finger guard 12, or by integrating a flexible, but more cut-resistant material into the finger guard 12.

The pad 16 is generally oval in shape an provides complete coverage for the back of the first joint of the finger. This is the area of a hairstylist's finger that routinely needs the most protection. The stylist or other user may wear a finger guard 12 on one or more fingers to meet their individual hand protection requirements.

The knuckle guard 10 and the finger guard 12 may be worn during all hairstyling activities, including, shampooing, chemical and coloring treatments, and cutting, either with or without protective gloves. The relatively small area covered by the knuckle guard 10 and the finger guard 12 does not appreciably impair or interfere with the stylist's activities.

Figure 4:
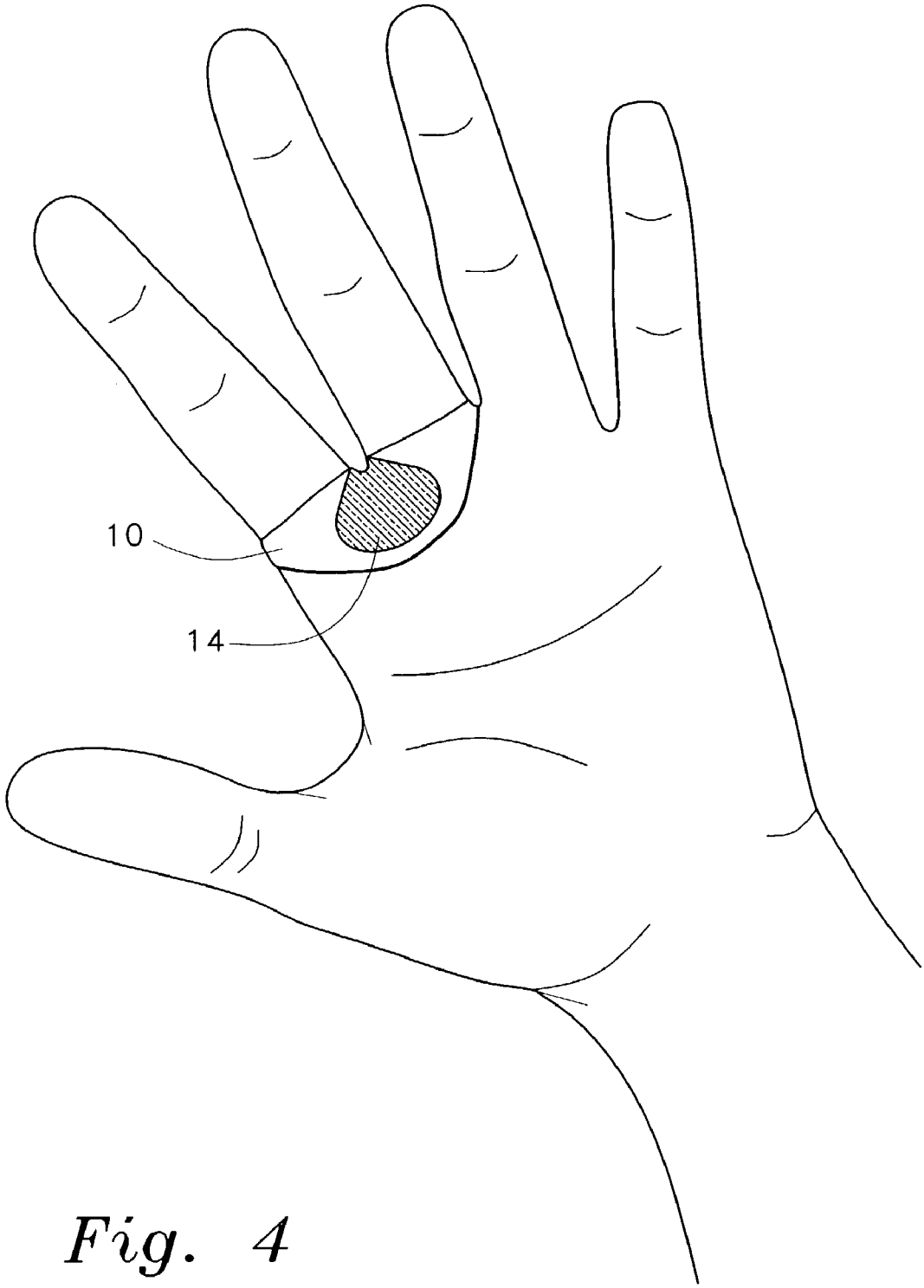
FIG. 4 is a perspective view of one embodiment of a hand and knuckle guard.
Figure 5:
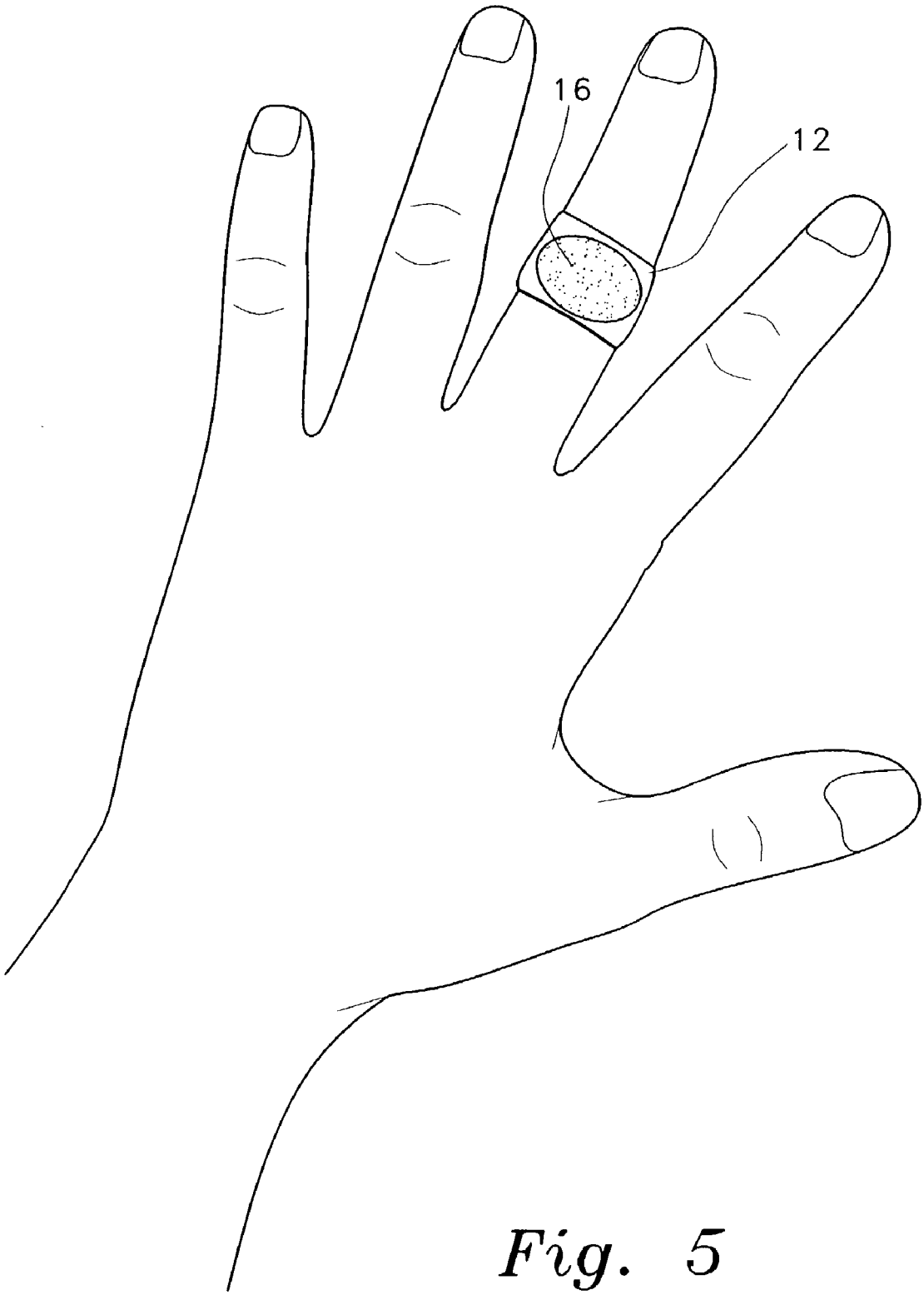
FIG. 5 is a perspective view of one embodiment of a hand and knuckle guard.

FIGS. 4 and 5 are perspective views of alternative embodiments of the hand and knuckle guard. FIG. 4 shows that the knuckle guard 10 may be worn alone, without the finger guard 12. FIG. 5 shows the finger guard 12 worn without the knuckle guard 10. The pieces offer the user excellent protection and flexibility, both in virtually unrestricted hand movement and with custom-tailored protection. The devices may be used in conjunction with other devices as well, to improve the protection characteristics of the other devices or to provide protection where the other devices do not.

It is to be understood that the present invention is not limited to the embodiments described above, but encompasses any and all embodiments within the scope of the following claims.

I claim:

1. A finger and knuckle guard comprising:

a protective knuckle cover made from a tough, flexible material, the knuckle cover having a pair of apertures defined therein adapted for placing the cover over the index and middle fingers of a user's hand, the knuckle cover being dimensioned and configured to cover the front and back of the first knuckles of the index and middle fingers without covering the phalanges of the index and middle fingers, the knuckle cover being truncated at approximately the top edge of the first knuckles of the index and middle fingers and the bottom edge of the first knuckles of the index and middle fingers, the knuckle cover having an isthmus extending between the two apertures, the isthmus being adapted to cover webbing of a user's hand between the index finger and the middle finger, the cover having a ventral portion configured to cover the palm side of the knuckles and a dorsal portion configured to cover the back side of the knuckles, the isthmus extending between the ventral and dorsal portions; and a finger cover made from a tough, flexible material, the finger cover having an aperture defined therein adapted for placing the finger cover over one of the fingers of a user's hand, the cover being dimensioned and configured to cover the front and back of the middle knuckle of one of the fingers without covering the phalanges of the finger, the finger cover being truncated at approximately the top edge and the bottom edge of the middle knuckle of one of the fingers.

2. The finger and knuckle guard of claim 1, further comprising a protective inset, the protective inset having an exaggerated hourglass shape and being integrated into the protective cover, the protective inset having two rounded ends and a tapered middle integrated into the isthmus of the protective cover.

* * * * *